US011078918B2

(12) United States Patent
Girard et al.

(10) Patent No.: US 11,078,918 B2
(45) Date of Patent: Aug. 3, 2021

(54) INTER-BLADE PLATFORM SEAL

(71) Applicants: SAFRAN AIRCRAFT ENGINES, Paris (FR); SAFRAN, Paris (FR)

(72) Inventors: Thibaut Dominique Augustin Girard, Moissy-Cramayel (FR); Lola Auliac, Moissy-Cramayel (FR); Jérémy Guivarc'h, Moissy-Cramayel (FR); Jérémy Philippe Pierre Edynak, Moissy-Cramayel (FR); Pierre Jean Faivre D'Arcier, Moissy-Cramayel (FR)

(73) Assignees: SAFRAN AIRCRAFT ENGINES, Paris (FR); SAFRAN, Paris (FR)

( * ) Notice: Subject to any disclaimer, the term of this patent is extended or adjusted under 35 U.S.C. 154(b) by 0 days.

(21) Appl. No.: 16/733,620

(22) Filed: Jan. 3, 2020

(65) Prior Publication Data

US 2020/0217217 A1 Jul. 9, 2020

(30) Foreign Application Priority Data

Jan. 4, 2019 (FR) ..... 1900080

(51) Int. Cl.
*F04D 29/08* (2006.01)
*F01D 5/02* (2006.01)
*F01D 11/00* (2006.01)

(52) U.S. Cl.
CPC ..... *F04D 29/083* (2013.01); *F01D 5/02* (2013.01); *F01D 11/006* (2013.01); (Continued)

(58) Field of Classification Search
CPC ..... F01D 5/30; F01D 11/001; F01D 11/008; F04D 29/083; F16J 15/102; F16J 15/104; F16J 15/022; F16J 15/025
See application file for complete search history.

(56) References Cited

U.S. PATENT DOCUMENTS 3,712,757 A * 1/1973 Goodwin ..... F01D 5/28 416/245 R
5,161,949 A * 11/1992 Brioude ..... F01D 5/22 416/193 A (Continued)

FOREIGN PATENT DOCUMENTS

FR 2987086 8/2013
GB 1276106 A * 6/1972 ..... F01D 21/045

(Continued)

OTHER PUBLICATIONS

Search Report dated Sep. 19, 2019, in corresponding French Patent Application No. 1900080 (2 pages).

*Primary Examiner* — Brian P Wolcott

(74) *Attorney, Agent, or Firm* — Bookoff McAndrews, PLLC

(57) ABSTRACT

Seal (10) for an inter-blade platform intended to extend circumferentially about an axis and to be mounted between two axial ends of the inter-blade platform, including a first part (10*a*) in contact with a first blade adjacent to a first circumferential end of the platform, and a second part (10*b*) in contact with a second blade adjacent to a second circumferential end of the platform, the first part (10*a*) and the second part (10*b*) of the seal (10) being fixed to each other such that a displacement in the circumferential direction of one of the two parts (10*a*, 10*b*) of the seal (10) causes a displacement of the other part (10*a*, 10*b*) of the seal (10) in the same direction, when the two parts (10*a*, 10*b*) of the seal (10) are fixed to each other.

8 Claims, 6 Drawing Sheets

(52) U.S. Cl.
CPC ..... *F01D 11/008* (2013.01); *F05D 2220/36* (2013.01); *F05D 2240/20* (2013.01); *F05D 2240/55* (2013.01)

(56) References Cited

U.S. PATENT DOCUMENTS

| | | | | |
|---|---|---|---|---|
| 6,217,283 | B1 * | 4/2001 | Ravenhall | F01D 11/008 416/2 |
| 7,942,636 | B2 * | 5/2011 | Evans | F01D 11/006 416/193 R |
| 7,950,900 | B2 * | 5/2011 | Mulcaire | F01D 11/008 415/208.2 |
| 8,535,013 | B2 * | 9/2013 | Care | F01D 11/008 416/221 |
| 9,228,444 | B2 * | 1/2016 | Evans | F01D 5/225 |
| 9,869,323 | B2 * | 1/2018 | Ravier | F04D 29/16 |
| 2008/0018056 | A1 * | 1/2008 | Evans | F01D 11/006 277/590 |
| 2010/0322772 | A1 * | 12/2010 | Hoyland | F01D 11/008 416/193 A |
| 2016/0305439 | A1 * | 10/2016 | Alarcon | F04D 29/322 |

FOREIGN PATENT DOCUMENTS

| | | | | |
|---|---|---|---|---|
| GB | 2489222 A | * | 9/2012 | F04D 29/322 |
| GB | 2489222 A | | 9/2012 | |

* cited by examiner

--Prior Art--

INTER-BLADE PLATFORM SEAL

CROSS-REFERENCE TO RELATED APPLICATION(S)

The application claims priority under 35 U.S.C. § 119 to French Patent Application No. 1900080, filed on Jan. 4, 2019, the entirety of which is incorporated by reference herein.

TECHNICAL FIELD

The invention relates to an inter-blade platform seal. Such a seal is disposed between a blade and an inter-blade platform separate from the blade, and aims at limiting the circulation of air between the blade and the inter-blade platform. Such a seal is in particular used, but not exclusively, in the turbomachine fans, between the fan blades and the inter-blade platforms.

PRIOR ART

In a turbomachine, the blade platforms of the fan must ensure several functions. Aerodynamically, these platforms have the primary function of delimiting the air flowpath. In addition, they must also be capable of withstanding significant forces by deforming as little as possible and remaining secured to the disk that carries them.

In order to meet these different requirements, some configurations have been proposed in which the platforms have a first part, i.e. the flowpath wall, that allows defining the air flowpath and ensuring the retention of the platform when the engine is rotating, and a second part, i.e. the box, that allows limiting the deformations of the first part under the effects of the centrifugal forces and maintaining the platform in position when the engine is stopped.

A clearance is arranged between the platforms and the blades to allow said blades to have a limited displacement during the various phases of operation of the engine. However, the performance requirements of the turbomachines are reflected in a good control of the tightness at the root of the blades. To that end, the clearance is plugged by a seal made of elastomeric material fixed along the lateral edges of the platform and bearing against the adjacent blade.

A linear inter-blade platform seal as described in the document FR2987086 is known, having a length, comprising a linear base intended to be fixed to the inter-blade platform, and a linear lip extending from the linear base, said linear lip having a circumferential end configured to contact a wall on the side of an intrados or a wall on the side of an extrados of a blade. This type of seal extends along the intrados or extrados of a blade, including the leading edge and/or the trailing edge.

In the configurations where the blades are subjected to large movements, in particular because of the centrifugal forces, the seals must be designed and finely positioned to ensure permanent plating against the blades, and thus maintain a good tightness. However, it is difficult to find an optimized solution at any point of operation. Indeed, the seal must be at the same time flexible enough to accompany the movement of the blades, but also stiff enough not to turn over or tear off. The materials making it possible to meet these conditions can be expensive, and involve complex shapes, and therefore complex implementation. In addition, in case of large movement of the blades, this type of known seal may in some locations not properly fit the blade in the areas of sharp discontinuity or with small radius of curvature, such as in the vicinity of the leading edge or of the trailing edge of the blade. As a result, air flows between the blade and the inter-blade platform in these areas. The tightness of the air (or gas) flowpath is therefore not optimal, which deteriorates the performances of the turbomachine.

There is therefore a need for an inter-blade platform seal that allows at least partly overcoming the drawbacks mentioned above.

DISCLOSURE OF THE INVENTION

The present disclosure relates to a seal for an inter-blade platform intended to extend circumferentially about an axis and to be mounted between two axial ends of the inter-blade platform, the seal comprising at least a first part configured to be in contact with a first blade circumferentially adjacent to a first circumferential end of the platform, and at least a second part configured to be in contact with a second blade circumferentially adjacent to a second circumferential end of the platform; the first part and second parts of the seal being configured to be linked to each other such that a displacement in one circumferential direction of one of the first or second part of the seal causes a displacement of the other of the first or second part of the seal in the same direction, when the first part and second parts of the seal are linked to each other.

It is understood that the seal extends along a preferred direction, i.e. the axial direction. This axial direction is not necessarily rectilinear, and is preferably configured to follow the contours of the blade, in particular in the vicinity of the discontinuities of the blade. The length of the seal is thus defined and measured parallel to this axial direction, between the two axial ends of the platform. It is understood that the circumferential direction, or lateral direction, is a direction transverse to the axial direction. When the seal is mounted on a platform which is in turn mounted on a wheel of a turbomachine fan, the circumferential direction is a direction tangent to the wheel, and perpendicular to the axis of rotation of the fan.

The platform seal includes two parts distinct from each other. When the seal is mounted on a platform, the two parts of the seal are linked to each other such that the seal extends on either side of the platform in the circumferential direction, from the first circumferential end of the platform up to the second circumferential end of the platform. Thus, the first part ensures the tightness between the platform and the intrados of a blade, and the second part ensures the tightness between said platform and the extrados of a second blade, adjacent to the first blade. By "linked to each other", or secured to each other, is meant that they are in contact with each other, that is to say, communicate with each other for example by being fixed to each other, such that a motion in the circumferential direction of one of the first and second parts causes a displacement, by reaction, of the other of the first and second parts. In other words, the movement of one of the first and second parts in the circumferential direction cannot be done without movement of the other of the first and second parts in this direction.

Consequently, during a movement of the blades, for example due to the centrifugal forces, a first blade tends to crush the first part of the seal, thus ensuring the tightness between said first blade and the platform. In addition, a second blade, adjacent to the first one and moving in the same direction as the first blade, tends to move away from the platform. However, the force exerted by the first blade on the first part of the seal is transmitted to the second part of the seal, which can thus follow the motion of the second blade. The second part of the seal can therefore ensure the tightness between the platform and the second blade. Consequently, the seal of the present disclosure can follow the global motion of the blades, thus making it possible to improve the tightness at the root of the blades, and thus to improve the performances of the turbomachine.

In some embodiments, the first part of the seal comprises a first contact portion made of elastomeric material, the first contact portion being configured to be in contact with the first circumferential end of the platform and the first blade adjacent to the first circumferential end of the platform, and the second part of the seal comprises a second contact portion made of elastomeric material, the second contact portion being configured to be in contact with the second circumferential end of the platform and the second blade adjacent to the second circumferential end of the platform.

The first and second contact portions are configured to be in contact with the platform and a blade adjacent to said platform. The first and second contact portions are therefore disposed at the circumferential ends of the seal, and over the entire length of the latter in the axial direction. With the first and second contact portions made of elastomeric material, the circumferential ends of the seal are locally more flexible than the portions of the seal other than the contact portions. The contact portions make it possible to better fit the contour of the blades, in particular in the areas of sharp discontinuity or with a small radius of curvature of the blade.

In some embodiments, the first part of the seal comprises a first structural portion, and the second part of the seal comprises a second structural portion, the first structural portion and the second structural portion being configured to be assembled to each other.

The structural portions allow ensuring the rigidity of the seal, and also transmitting the forces exerted on the first contact portion at a circumferential end of the seal to the second contact portion at the other circumferential end of the seal.

Furthermore, when the platform is mounted in a turbomachine fan, the first structural portion and the second structural portion can be fixed to each other radially under a flowpath wall of the platform. The flowpath wall of the platform is the wall that allows delimiting the flowpath of the air entering the fan. By "radially under a flowpath wall of the platform", is meant that the structural portions are disposed on a radially inner face of the flowpath wall of the platform when the platform is mounted in a fan. The structural portions are therefore disposed on one side of the flowpath wall opposite to the side of the flowpath wall where the air flows. The Fixing operation of the first structural portion with the second structural portion is therefore carried out radially under the flowpath wall. According to this configuration, a displacement of the first part of the seal generates a displacement of the second part of the seal, the seal thus moving in block by radially sliding under the flowpath wall of the platform.

In some embodiments, each of the first and second structural portions comprises a metal material.

The fact that the first and second structural portions comprise a metal material allows improving the rigidity of the seal, and also ensuring more effectively the circumferential displacement of the seal on either side of the platform. The first and second structural portions may be for example in the form of a metal plate slid radially under the flowpath wall of the platform.

In some embodiments, the first contact portion, respectively the second contact portion, is fixed to the first structural portion, respectively to the second structural portion, by being bonded along the latter.

Preferably, the first contact portion, respectively the second contact portion, is bonded over the entire length, in the axial direction, of the first structural portion, respectively of the second structural portion.

Alternatively, the first and second contact portions may include a groove extending along said portion in the axial direction, the groove being able to nest with one end of the structural portion. The structural portion may also be embedded in the elastomer, so that the structural portion also includes an elastomer, integral with the contact portions. These fixing modes allow a simple assembly of the different parts of the seal.

In some embodiments, in a cross-section parallel to the circumferential direction, the first and second contact portions have a rectangular shape, one side of the rectangle being configured to be in contact with an adjacent blade, another side being configured to be in contact with the platform.

The first and second contact portions are preferably configured to be disposed partly radially under the flowpath wall. The shape and disposition of the first and second contact portions allow facilitating their sliding radially under the flowpath wall, and thus facilitating the displacement of the seal on either side of the platform.

In some embodiments, at least one of the first and second structural portions comprises at least one tab extending in the circumferential direction, one circumferential end of said tab being configured to come into contact with the other of the first and second structural portions.

By "tab" is meant a plate having a larger dimension in the circumferential direction than in the axial direction. In other words, the tab of the first and/or second structural portion does not extend over the entire length, in the axial direction, of the seal. When the first part and the second part of the seal are assembled, the circumferential end of the tab of the first structural portion, for example, comes into contact with the second structural portion. The forces exerted by a blade at a circumferential end of the seal are then transmitted to the other end of the seal via the tab.

The first structural portion, for example, may also include two tabs, or more, the circumferential ends of each of them coming into contact with the second structural portion. Thus, when the first part and the second part of the seal are assembled, the seal is in the form of a plate comprising windows. The structure of the structural portions comprising tabs allows facilitating the assembly of the two parts of the seal, in particular the insertion of each of the structural portions under the flowpath wall. Moreover, the shape and the number of the tabs are not limited, and can be adapted according to the structure of the platform on which the seal is mounted.

In some embodiments, each of the first and second structural portions comprises at least one tab extending in the circumferential direction, a circumferential end of said tab being configured to come into contact with a circumferential end of the tab of the other of the first and second structural portions.

Preferably, each of the first and second structural portions comprises the same number of tabs. Each tab of the first or second structural portion is disposed so as to face a tab of the other of the first or second structural portion when the first and second parts of the seal are assembled. The axial ends of each of these tabs are thus in contact with each other when the first and second parts of the seal are assembled.

In some embodiments, the first part of the seal comprises at least a first attachment part fixed to a tab of the first structural portion, and the second part of the seal comprises at least a second attachment part fixed to a tab of the second structural portion, the first and second attachment parts being configured to cooperate together so as to assemble the first part of the seal to the second part of the seal.

The first attachment part and the second attachment part are preferably fixed under the tab of the first and the second structural portion respectively, that is to say on a radially inner face of these structural portions when the seal is mounted on a platform, itself mounted on a turbomachine fan. The attachment parts may be fixed by being added onto the tabs, for example by welding, or be molded or machined into a block, in the same material as the first and second structural portions.

The first and second attachment parts allow the first and second parts of the seal to be assembled and fixed such that said first part and said second part of the seal are linked to each other. The first attachment part may be for example a female attachment part, and the second attachment part may be a male attachment part that is fixed, for example by clipping, on the female attachment part.

There may be as many attachment parts as tabs. More specifically, when each of the first and second structural portions includes two tabs, a first tab of the first structural portion may include a first attachment part, and a first tab of the second structural part may include a second attachment part configured to be fixed to the first attachment part. Similarly, a second tab of the first structural portion may include a first attachment part, and a second tab of the second structural part may include a second attachment part configured to be assembled to the first attachment part.

In some embodiments, the assembly between the first attachment part and the second attachment part is reversible. This thus offers the possibility of easily separating the first and second parts of the seal, for maintenance or replacement of the latter.

The present disclosure also relates to an inter-blade platform comprising a seal according to any one of the previous embodiments, the first part of the seal being fixed to the second part of the seal.

In some embodiments, the platform comprises a box delimited by a flowpath wall to define an air flowpath, the box comprising at least one lateral passage configured to accommodate a tab of a first and/or or a second structural portion of the seal.

The box allows maintaining in position the flowpath wall, and also limiting its deformations under the effect of centrifugal forces. The box also includes a bottom surface that can bear on a fan disk. The passages existing in the box are orifices disposed radially under the flowpath wall, preferably adjacent thereto, and the dimensions of which allow the passage of the tab(s) of the structural portions of the seal. The presence of these passages allows the assembly of the first and second parts of the seal, and makes possible the communication of the first and second parts of the seal via the tabs, and thus the displacement of the seal extending on either side of the platform in a circumferential direction, radially under the flowpath wall.

The present disclosure also relates to a rotor comprising a disk at the periphery of which a plurality of blades and a plurality of inter-blade platforms are mounted according to any one of the previous embodiments, each platform being disposed between each pair of adjacent blades.

The present disclosure also relates to a turbomachine and particularly a turbojet engine comprising a rotor according to the previous embodiment.

BRIEF DESCRIPTION OF THE DRAWINGS

The invention and its advantages will be better understood upon reading the detailed description below of various embodiments of the invention given by way of non-limiting examples. This description refers to the pages of appended figures, in which.

DESCRIPTION OF THE EMBODIMENTS

In the present disclosure, the term "axial" and its derivatives are defined in relation to the main direction of the considered seal and platform; the term "circumferential" and its derivatives are defined in relation to the direction that extends about the axial direction; the terms "radial", "internal", "external" and their derivatives are for their part defined in relation to the main axis of the turbomachine, when the platform is mounted on a disk which is in turn mounted in the turbomachine; finally, the terms "above", "below", "lower", "upper" and their derivatives are defined in relation to the radial direction facing the axis about which the turbomachine extends. Also, unless otherwise indicated, the same reference signs in different figures refer to the same characteristics.

Figure 1:
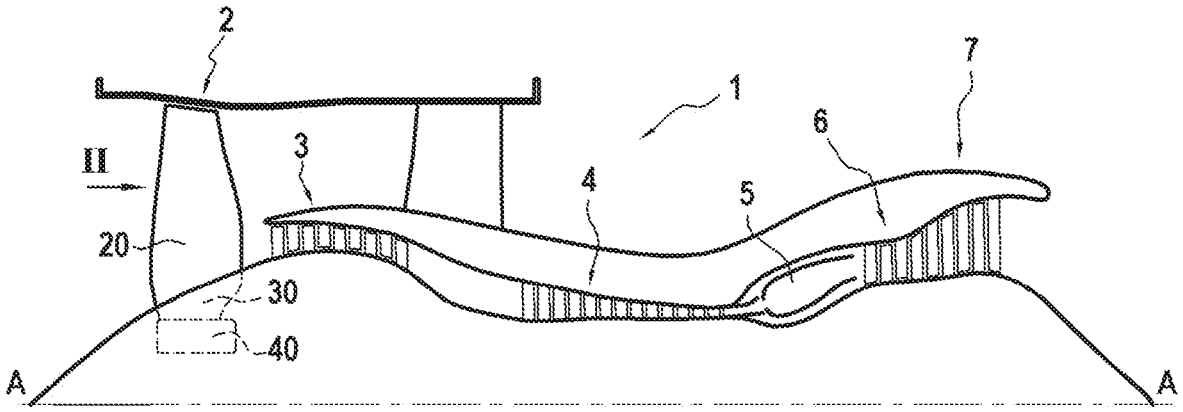
FIG. 1 represents a schematic sectional view of a turbojet engine according to the invention.

FIG. 1 shows a schematic longitudinal sectional view of a bypass turbomachine 1 centered on the axis A about which the turbomachine extends. It includes, from upstream to downstream: a fan 2, a low-pressure compressor 3, a high-pressure compressor 4, a combustion chamber 5, a high-pressure turbine 6, and a low-pressure turbine 7.

Figure 2:
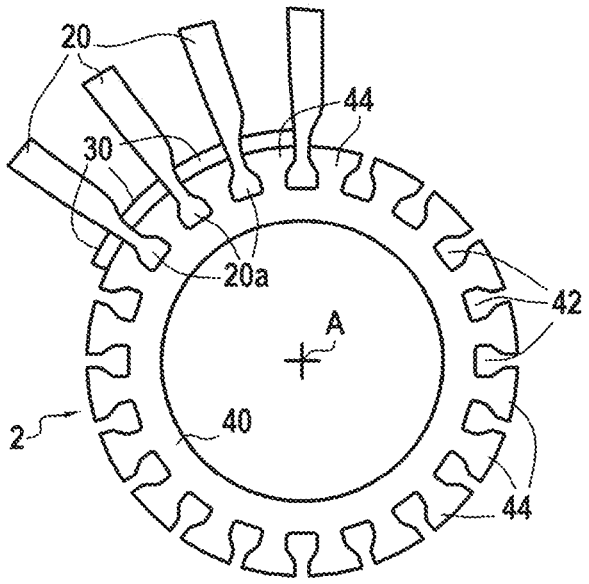
FIG. 2 represents a schematic view along the direction II of the fan of FIG. 1.

FIG. 2 shows a schematic view of the fan 2 of FIG. 1 along the direction II. The fan 2 comprises a fan disk 40 in which a plurality of grooves 42 are made at its external periphery. These grooves 42 are rectilinear and extend axially from upstream to downstream all along the disk 40. They are further evenly distributed all about the axis A of the disk 40. In this way, each groove 42 defines with its neighboring one a tooth 44 which also extends axially from upstream to downstream all along the disk 40. In an equivalent manner, a groove 42 is delimited by two circumferentially adjacent teeth 44.

The fan 2 further comprises a plurality of blades 20 of curvilinear profile (only four blades 20 have been represented in FIG. 2). Each blade 20 has a root 20*a* which is mounted in a respective groove 42 of the fan disk 40. For this purpose, the root 20*a* of a blade 20 may have a fir tree or dovetail shape adapted to the geometry of the grooves 42, each root 20*a* having a shape at least partly complementary to the shape of the groove 42 in which it is mounted.

Finally, the fan 2 comprises a plurality of added platforms 30, each platform 30 being mounted in the interval that extends circumferentially between two adjacent fan blades 20, in the vicinity of the root 20*a* thereof, in order to delimit, on the internal side, an annular flowpath for entering air in the fan 2, the flowpath being delimited on the external side by a fan casing (not represented).

Figure 3:
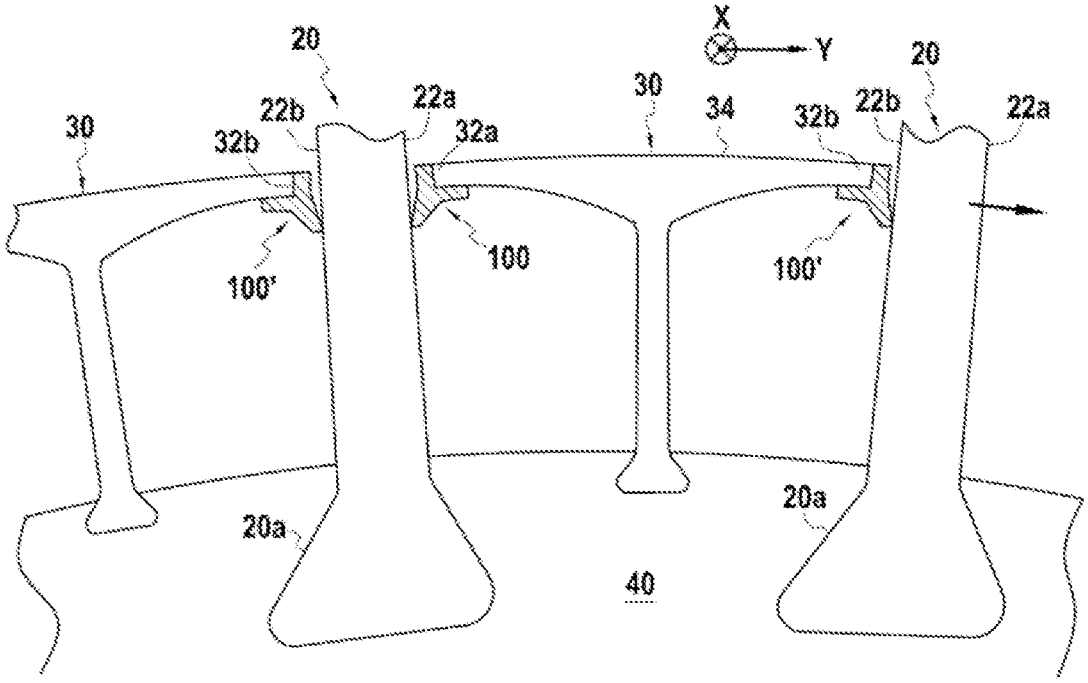
FIG. 3 represents a partial view of a section of a fan according to the prior art, FIG. 4A schematically represents a bottom view of a seal according to the invention when the first and second parts of the seal are joined.

As illustrated in FIG. 3, each edge, or circumferential end 32*a*, 32*b*, of each platform 30, respectively facing the intrados 22*a* side and the extrados 22*b* side of a blade 20, is respectively equipped with a seal 100 and with a seal 100' according to the prior art, extending along said circumferential ends 32*a*, 32*b* in the axial direction. In this example, the seal 100 is configured to cooperate with the blade 20 on the intrados 22*a* side while the seal 100' is configured to cooperate with the blade 20 on the extrados 22*b* side. A movement of a first blade 20 (the one on the left in FIG. 3) in the circumferential direction Y tends to exert a pressure on the seal 100. Conversely, a movement of a second blade 20 (the one on the right in FIG. 3) in the same circumferential direction Y tends to move this blade 20 away from the seal 100' (arrow in FIG. 3).

Figure 4A:
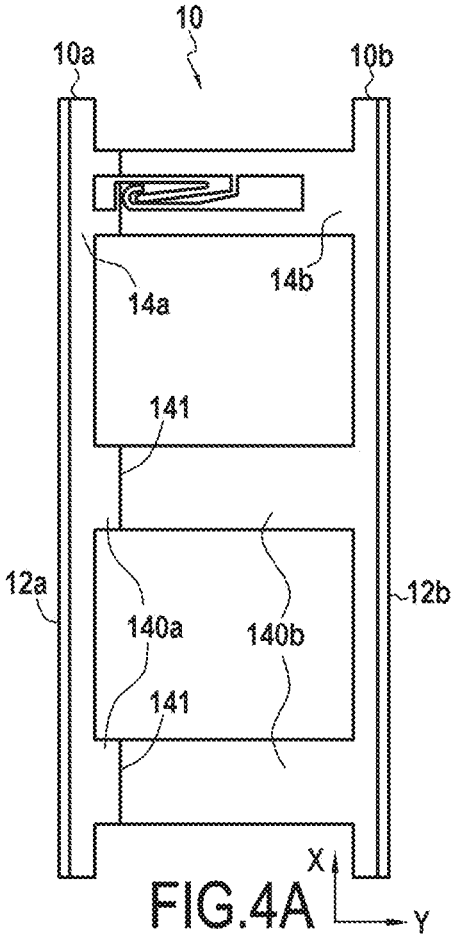
FIG. 4B represents a bottom view of a seal according to the invention when the first and second parts of the seal are disjointed.
Figure 4B:
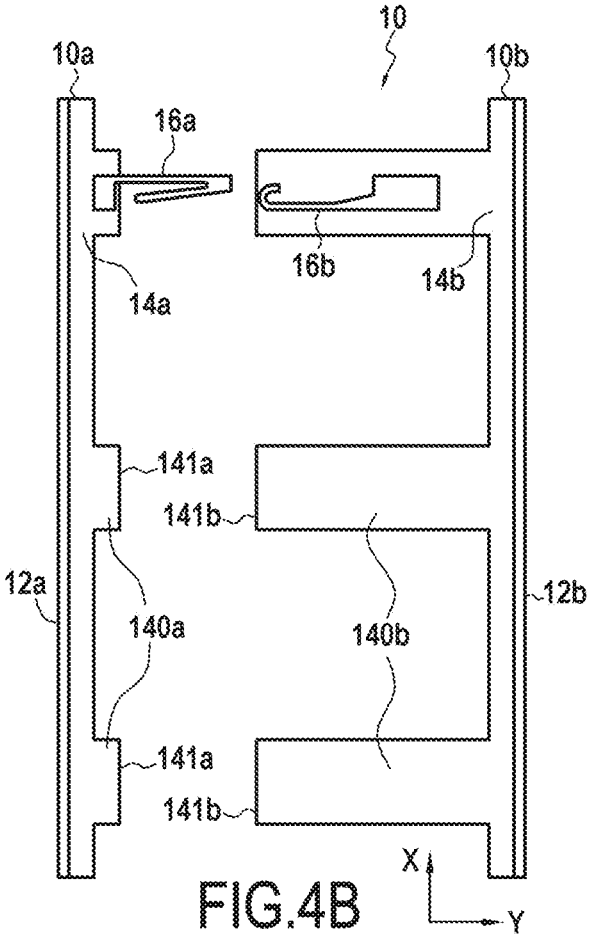

FIGS. 4A and 4B schematically represent a bottom view of a seal 10 according to the invention when the first and second parts of the seal are joined (FIG. 4A) and disjointed (FIG. 4B). The axis X represents the axial direction, and the axis Y represents the circumferential direction. When the seal 10 is mounted on a platform 30 which is in turn mounted on a fan disk, the axis X is substantially parallel to the central axis A of the turbojet engine. In these figures, the circumferential ends of the seal 10 have a rectilinear shape in the axial direction X. This illustration is schematic, with the seal 10 not limited to this shape. On the contrary, the circumferential ends of the seal 10 may have a curved shape, so as to fit the shape of the profile of the blade with which they are in contact when the seal 10 is mounted on a fan platform. Furthermore, the face of the seal 10 illustrated in FIGS. 4A and 4B, in this bottom view, is the face directed towards the axis of the fan when the seal 10 is mounted on a fan platform, in other words, the radially inner face of the seal 10.

The seal 10 comprises a first part 10*a* and a second part 10*b*, separate from the first part 10*a*. The first part 10*a* comprises a first contact portion 12*a*, and a first structural portion 14*a*, fixed to each other, for example by bonding. Similarly, the second part 10*b* comprises a second contact portion 12*b*, and a second structural portion 14*b*, fixed to each other, for example by bonding. The contact portions 12*a*, 12*b* each comprise an elastomeric material, and are provided to be in contact, respectively, with the circumferential end 32*a* of the platform 30 and a blade adjacent to said circumferential end 32*a*, and the circumferential end 32*b* of the platform 30 and a blade adjacent to said circumferential end 32*b*.

The structural portions 14*a*, 14*b* each comprise a metal material, for example an aluminum alloy, and may also include a carbon composite. Alternatively, the structural portions may include an elastomer having an embedded part made of aluminum alloy or be entirely metallic, made of aluminum or titanium alloy. In the example illustrated in FIGS. 4A and 4B, the first structural portion 14*a* comprises three tabs 140*a*, and the second structural portion 14*b* also comprises three tabs 140*b*. The circumferential ends 141*a* of the tabs 140*a* of the first structural portion 14*a* are configured to come into contact with the circumferential ends 141*b* of the tabs 140*b* of the second structural portion 14*b*, when the first and second parts 10*a*, 10*b* of the seal are assembled. According to this embodiment, the tabs 140*a* of the first structural portion 14*a* are shorter, in the circumferential direction, than the tabs 140*b* of the second structural portion 14*b*. However, the seal 10 is not limited to this structure. The tabs 140*a*, 140*b* may for example have an equal length. Similarly, the dimension of the tabs along the axial direction X is given as an illustration in FIGS. 4A, 4B, and may vary according to the structure of the platform 30 on which the seal 10 is mounted. The number of these tabs may also vary, and may be less than or greater than three for each structural portion 14*a*, 14*b*, each tab 140*a* of the first structural portion 14*a* having to face, along the circumferential direction Y, a tab 140*b* of the second structural portion 14*b*.

Furthermore, the seal 10 includes a first attachment part 16*a* fixed to a tab 140*a* of the first structural portion 14*a*, and a second attachment part 16*b* fixed to a tab 140*b* of the second structural part 14*b*. These attachment parts 16*a*, 16*b* are fixed on a radially inner face of the seal 10, when the latter is mounted on a fan platform 30. In FIG. 4A, a single pair of attachment parts 16*a*, 16*b* is illustrated. Nevertheless, a first attachment part 16*a* may be provided on both or each tab 140*a* of the first structural portion 14*a*. Similarly, a second attachment part 16*b* may be provided on both or each tab 140*b* of the second structural portion 14*b*.

Figure 5A:
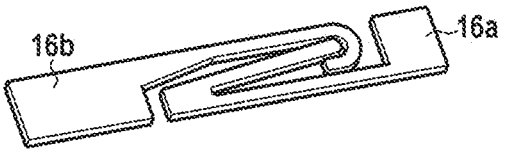
FIG. 5A represents a perspective view of a first and a second attachment part of the seal according to the invention in the locked position.
Figure 5B:
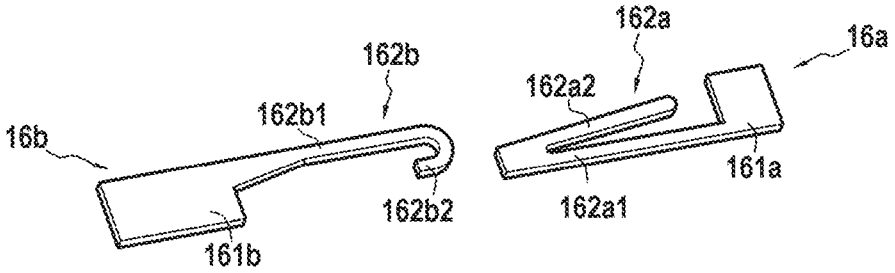
FIG. 5B represents a perspective view of a first and a second attachment part of the seal according to the invention in the unlocked position.

FIGS. 5A et 5B represent a perspective view of a first and a second attachment part 16*a*, 16*b* of the seal 10 according to the invention, when these are in the locked position and in the unlocked position, respectively. The first attachment part 16*a* comprises a first attachment portion 161*a* fixed to the tab 140*a*, for example by welding, and a first pin part 162*a* comprising a first branch 162*a*1 extending in the circumferential direction from the fixing portion 161*a*, and a second branch 162*a*2 extending from the circumferential end of the first branch 162*a*1 toward the attachment portion 161*a*. The second attachment part 16*b* comprises a second fixing portion 161*b* fixed to the tab 140*b*, for example by welding, and a second pin part 162*b* comprising a first branch 162*b*1 extending in the circumferential direction from the fixing portion 161*b*, and a hook 162*b*2 extending from the first branch 162*b*1 such that the end of the hook 162*b*2 is directed toward the fixing portion 161*b*.

When the first and second parts 10*a*, 10*b* of the seal 10 are brought closer to each other, the second branch 162*a*2 of the first pin part 162*a* slides along the hook 162*b*2 of the second pin part 162*b*, by elastically deforming so as to come closer to the first branch 162*a*1. When the first and second parts 10*a*, 10*b* of the seal 10 are brought further closer to each other, such that the circumferential ends 141*a* and 141*b* of the tabs 140*a*, 140*b* abut against each other along a contact surface 141, the end of the second branch 162*a*2 of the first pin part 162*a* passes over the hook end 162*b*2 by again moving away from the first branch 162*a*1, when the first pin part 162*a* returns to its initial shape. The first and second attachment parts 16*a*, 16*b* are thus in the locked position, and the first and second parts 10*a*, 10*b* are then joined to each other. It is also possible to separate the two parts 10*a*, 10*b* from each other, by exerting a force on the first part 10*a* in the axial direction X, so as to release the second branch 162*a*2 from the hook 162*b*2.

Figure 5C:
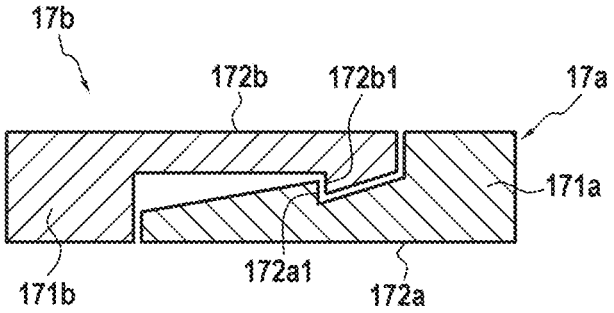
FIG. 5C represents a front view of a first and a second attachment part of the seal according to another example of the invention in the locked position.

FIG. 5C represents a perspective view of a first and a second attachment part 17*a*, 17*b* of the seal 10 of the invention according to an alternative example, when these are in the locked position. The first attachment part 17*a* comprises a first attachment portion 171*a* fixed to the tab 140*a*, for example by welding, and a first notched part 172*a* extending in the circumferential direction from the fixing portion 171*a*, the first notched part 172*a* including a first step 172*a*1 extending perpendicular to the circumferential direction. The second attachment part 17*b* comprises a second fixing portion 171*b* fixed to the tab 140*b*, for example by welding, and a second notched part 172*b* extending in the circumferential direction from the fixing portion 171*b*, the second notched part 172*b* including a second step 172*b*1 extending perpendicular to the circumferential direction.

When the first and second parts 10*a*, 10*b* of the seal 10 are brought closer to each other, an inclined wall of the first notched part 172*a* slides along an inclined wall of the second notched part 172*b*, by both deforming elastically. When the first and second parts 10*a*, 10*b* of the seal 10 are brought further closer to each other, such that the circumferential ends 141*a* and 141*b* of the tabs 140*a*, 140*b* abut against each other according to the contact surface 141, the first step 172*a*1 passes over the second step 172*b*1, such that the first and second notched parts are hooked to each other. The first and second attachment parts 17*a*, 17*b* are thus in the locked position, and the first and second parts 10*a*, 10*b* are then joined to each other.

Figure 6A:
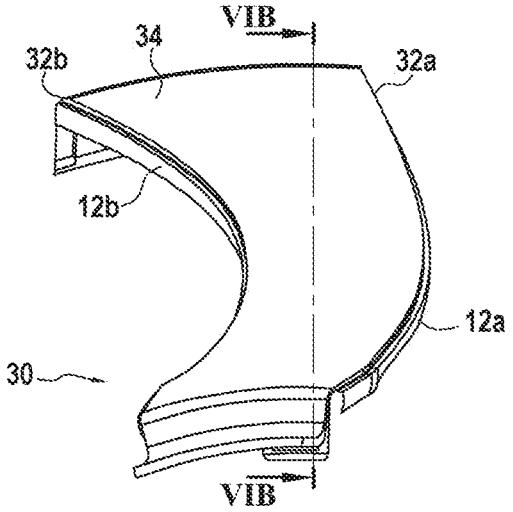
FIG. 6A represents a perspective view of a platform according to the invention.
Figure 6B:
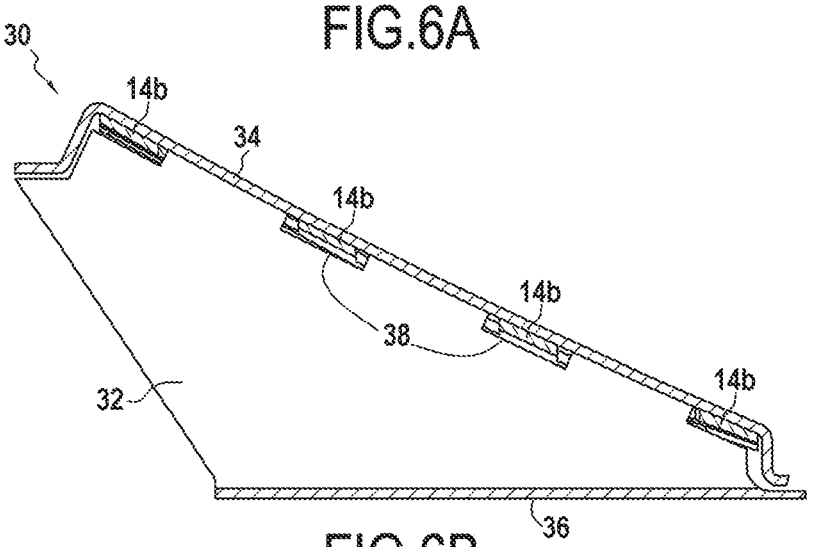
FIG. 6B represents a lateral section of the platform of FIG. 6A according to a section plane VIB-VIB.

FIG. 6A represents a perspective top view of a platform 30 according to the invention, on which a seal 10 is mounted, and FIG. 6B represents a lateral section of the platform of FIG. 6A along a section plane VIB-VIB. The platform 30 includes a box 32 for maintaining in position the flowpath wall 34, and also limiting its deformations under the effect of centrifugal forces. The box 32 also includes a bottom surface 36 that can bear against a tooth 44 of the disk 40 of the fan. The box 32 includes lateral passages 38 in its radially external part, radially under the flowpath wall 34. Each structural portion 14*a*, 14*b* includes as many tabs 140*a*, 140*b* as there are passages 38. When the seal 10 is mounted on the platform 30, the first part 10*a* is inserted radially under the flowpath wall 34 from a circumferential end 32*a* of the platform 30, by passing the tabs 140*a* through the passages 38. Similarly, the second part 10*b* is inserted radially under the flowpath wall 34 from the other circumferential end 32*b* of the platform 30, by passing the tabs 140*b* through the passages 38, until the lateral ends 141*a*, 141*b* come into contact with each other along the contact surface 141, and the first and second attachment parts 16*a*, 16*b* are in the locked position.

Figure 7:
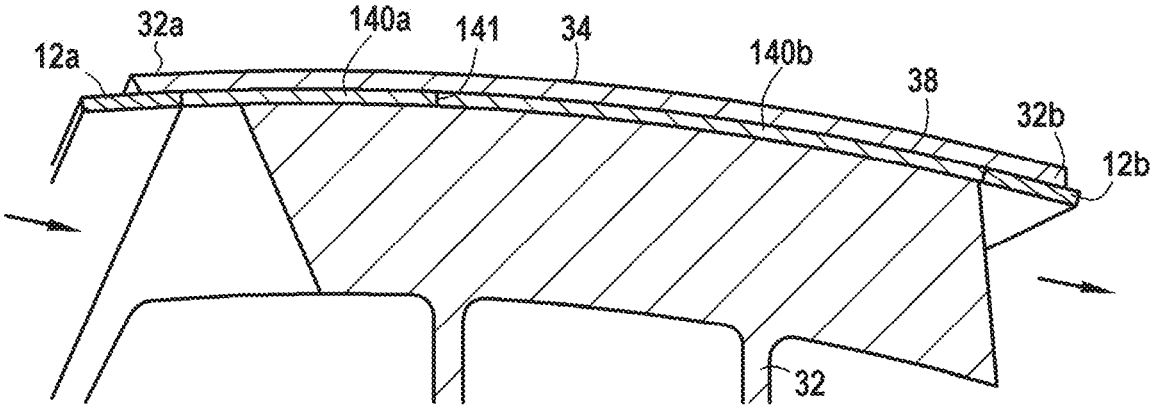
FIG. 7 represents a sectional view along a plane parallel to the circumferential direction of the platform according to the invention.

FIG. 7 represents a sectional view along a plane parallel to the circumferential direction of the platform 30, at a passage 38. According to this embodiment, the contact portions 12*a*, 12*b* have a rectangular section. However, this shape is not limiting, other shapes allowing the contact portions 12*a*, 12*b* to slide partly radially under the flowpath wall 34 are conceivable. The contact portions may for example have a flared shape toward the area of contact with the blade, or a substantially T-shape, as illustrated in FIG. 3. When the blades 20 (not illustrated in FIG. 7) move in the direction of the arrows in FIG. 7, a blade 20 exerts a force on the contact portion 12*a*, and therefore on the structural portion 14*a*. This force is transmitted to the structural portion 14*b* via the contact surface 141 at the ends of the tabs. A displacement of the entire seal 10 is thus generated, the seal 10 sliding under the flowpath wall 34 by passing through the passages 38. The resulting displacement of the contact portion 12*b*, in the direction of the arrow in FIG. 7 thus allows compensating for the movement of the blade 20 in the same direction, and thus maintaining the sealing function of the contact portion 12*b*, between the circumferential end 32*b* of the platform and the blade 20.

Although the present invention has been described with reference to specific exemplary embodiments, it is obvious that modifications and changes can be made to these examples without departing from the general scope of the invention as defined by the claims. Particularly, individual characteristics of the various illustrated/mentioned embodiments can be combined in additional embodiments. Consequently, the description and drawings should be considered in an illustrative rather than restrictive sense.

The invention claimed is:

1. An inter-blade platform comprising a seal configured to extend circumferentially about an axis and to be mounted between two axial ends of the inter-blade platform, the seal comprising at least a first part configured to be in contact with a first blade circumferentially adjacent to a first circumferential end of the platform, and at least a second part configured to be contact with a second blade circumferentially adjacent to a second circumferential end of the platform, the first part and the second part of the seal being distinct from each other and being configured to be fixed to each other such that a displacement in one circumferential direction of one of the first or second part of the seal causes a displacement of the other one of the first or second part of the seal in the same direction, when the first part and the second part of the seal are fixed to each other, wherein a first structural portion and/or a second structural portion of the seal comprises at least one tab, and the inter-blade platform comprises a box delimited by a flowpath wall to define an air flowpath, the box comprising at least one lateral passage, wherein the at least one lateral passage is an orifice formed in a lateral wall of the box configured to accommodate the at least one tab and to allow displacement of the seal extending on either side of the platform in a circumferential direction, radially under the flowpath wall.

2. The inter-blade platform according to claim 1, wherein the first part of the seal comprises a first contact portion made of elastomeric material, the first contact portion being configured to be in contact with the first circumferential end of the platform and the first blade circumferentially adjacent to the first circumferential end of the platform, and the second part of the seal comprises a second contact portion made of elastomeric material, the second contact portion being configured to be in contact with the second circumferential end of the platform and the second blade circumferentially adjacent to the second circumferential end of the platform.

3. The inter-blade platform according to claim 1, wherein the first part of the seal comprises the first structural portion, and the second part of the seal comprises the second structural portion, the first structural portion and the second structural portion being configured to be assembled with each other.

4. The inter-blade platform according to claim 3, wherein each of the first and second structural portions comprises a metal material.

5. The inter-blade platform according to claim 3, wherein the at least one tab extends circumferentially, one circumferential end of the at least one tab being configured to come into contact with the other one of the first and second structural portions.

6. The inter-blade platform according to claim 5, wherein the first part of the seal comprises at least a first attachment part fixed to at least one tab of the first structural portion, and the second part of the seal comprises at least a second attachment part fixed to at least one tab of the second structural portion, the first and second attachment parts being configured to cooperate together so as to assemble the first part of the seal to the second part of the seal.

7. A rotor comprising a disk at the periphery of which a plurality of blades and a plurality of inter-blade platforms according to claim 1 are mounted, each platform being disposed between each pair of circumferentially adjacent blades.

8. A turbomachine comprising a rotor according to claim 7.

* * * * *